United States Patent [19]

Glynn et al.

[11] 4,249,713

[45] Feb. 10, 1981

[54] ROOF ATTACHMENT MEMBER FOR SAFETY LINES

[76] Inventors: John H. Glynn, 7 Richgrove Dr., Apt. 1006, Weston, Ontario M9R 2L1, Canada; Patrick J. Glynn, 307 The Kingsway, Apt. C2, Islington, Ontario, M9A 3V3, Canada

[21] Appl. No.: 63,120

[22] Filed: Aug. 2, 1979

Related U.S. Application Data

[63] Continuation of Ser. No. 890,616, Mar. 20, 1978, abandoned.

[51] Int. Cl.[3] ..... A47G 29/02

[52] U.S. Cl. ..... 248/237; 52/37

[58] Field of Search ..... 248/499, 536, 237, 216.4, 248/220.1, 218.4, 219.2, 219.1, 300; 403/232.1; 52/27, 714, 37; 182/3, 45, 137, 150, 230; 24/129 B

[56] References Cited

U.S. PATENT DOCUMENTS

| | | | |
|---|---|---|---|
| 677,645 | 7/1901 | Elkins | 182/45 X |
| 742,565 | 10/1903 | Berry | 182/45 X |
| 829,637 | 8/1906 | Dodds | 403/188 X |
| 1,796,353 | 3/1931 | Williams et al. | 403/188 |
| 2,575,254 | 11/1951 | Blaugrund | 248/536 X |
| 3,184,800 | 5/1965 | Nelson | 52/714 X |
| 3,237,717 | 3/1966 | Jackson | 182/3 |
| 3,481,635 | 12/1969 | Tracy | 403/232.1 X |
| 4,008,669 | 2/1977 | Sumrell | 248/499 X |

FOREIGN PATENT DOCUMENTS

| | | | |
|---|---|---|---|
| 612448 | 6/1932 | Fed. Rep. of Germany | 182/45 |
| 271254 | 10/1950 | Switzerland | 182/3 |

*Primary Examiner*—J. Franklin Foss

*Attorney, Agent, or Firm*—Sim & McBurney

[57] ABSTRACT

There is provided an attachment member for roof peaks to which a safety line can be clipped. A strip of metal is bent to define a central portion with two juxtaposed panels, and outwardly extending legs adapted to be secured to roof joists. The central portion has an aperture for the hook portion of the clip, the hook being flattened. The aperture is elongated, and is narrower than the width of the flattened hook portion, whereby the hook portion, when engaged with the aperture, is restricted in terms of rotation.

3 Claims, 5 Drawing Figures

ROOF ATTACHMENT MEMBER FOR SAFETY LINES

This is a continuation-in-part of U.S. patent application Ser. No. 890,616, filed Mar. 20, 1978 now abandoned.

This invention relates to an attachment member for roof peaks, useful for the attachment of the end of a safety line securing a workman against slipping or falling from the roof on which he is working.

One conventional construction of an attachment member for safety lines involves the provision of an elongated bar or rod spaced from the roof peak, and fixed at either end thereto. A clip on the end of the safety line is adapted to travel along the rod, to allow the worker a certain degree of freedom. This form of safety line attachment suffers from the disadvantage of unnecessary complexity and thus high cost. Furthermore, considerable time has to be expended both in erecting the safety line attachment device and in dismantling it at the end of the roofing operation.

A further aspect of this invention is to provide an attachment member adapted to cooperate with a clip having a particular configuration, in such a way as to restrict the rotational freedom of the hook when engaged with the attachment member, thus keeping the hook in a relatively constant position, and therefore increasing the safety factor by ensuring against disengagement of the hook from the attachment member.

Accordingly, this invention provides, for use with a clip connected to a safety line for roof workers, the clip including a hook portion having a leading point with a flattened transverse section, said section having a minimum dimension and having a maximum dimension transverse to the general plane of the hook portion:

an attachment member for roof peaks to which the safety line can be clipped, comprising a strip of metal bent to define an upstanding central portion consisting of two panels of the metal integral through a 180° bend at the top, each panel being integral at its bottom with an outwardly extending leg portion having means to allow attachment to structural roof members, the metal being such as to allow deformation without rupture, the central portion having an aperture for the insertion of the hook portion of said clip, the aperture being elongated in the direction parallel with the said 180° bend, and having a length greater than said maximum dimension and a width between said maximum and minimum dimensions, whereby the clip once inserted in the aperture cannot be rotated beyond a limited arc.

One embodiment of this invention is illustrated in the accompanying drawings, in which like numerals denote like parts throughout the several views, and in which.

Figure 1:
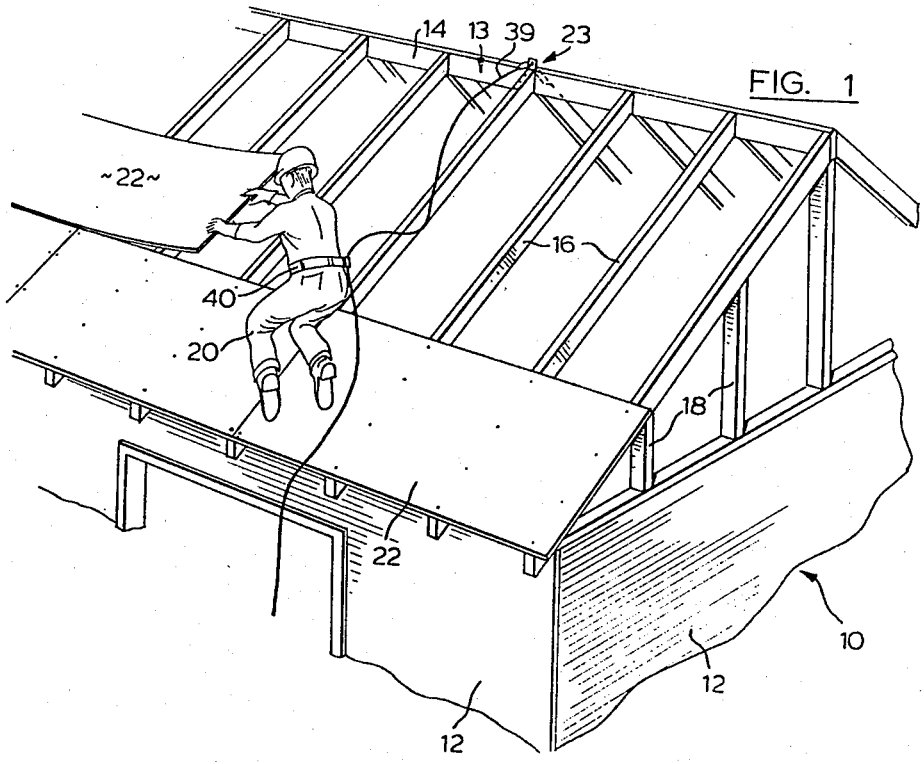
FIG. 1 is a perspective view of a house roof showing the invention in operation.

Turning first to FIG. 1, a house 10 in the midst of construction includes side walls 12 and a roofing framework 13 which consists of a roof beam 14, a plurality of rafters 16 extending obliquely down from the roof beam 14 to the tops of the walls 12, and studs 18.

In FIG. 1 a workman 20 is pictured laying 4'×8' sections of plywood 22 on the roof, prior to receiving tar paper or the equivalent, and an overlying layer of roofing shingles.

The attachment which has been devised is seen in FIG. 1 straddling the roof beam 14 and lying along the oppositely extending rafters 16 which are fourth from the righthand end. This attachment, identified generally by the numeral 23, is seen to a larger scale in FIG. 2.

The attachment comprises a strip of metal 24 which is bent to define an upstanding central portion 26 consisting of two panels 27 and 28 of the metal, the panels 27, 28 being integral with each other through a 180° bend at the top 30. Each panel 27, 28 is integral at its bottom with an outwardly extending leg portion 32. Each leg portion 32 is provided with means to allow attachment of the leg portion to structural roof members, and in FIG. 2 these means are constituted by three aligned openings 33 for receiving nails.

Figure 2:
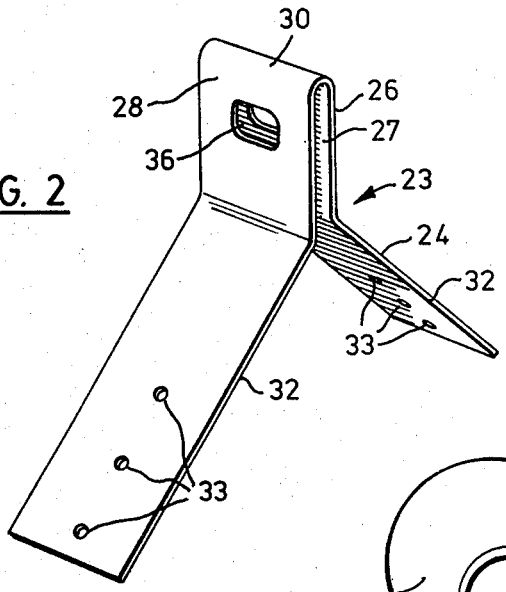
FIG. 2 is a perspective view of the attachment member, seen at a larger scale.
Figure 5:
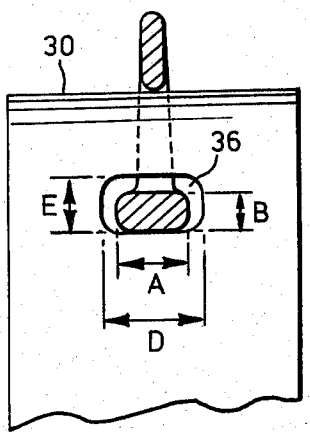
FIG. 5 is a vertical sectional view taken at the line 5—5 in FIG. 4.

As can be seen in FIGS. 2 and 5, the central portion 26 has an aperture 36 (extending through both panels 27 and 28), for insertion of a hook portion 37 of a clip 38. The clip 38 is affixed to the end of a safety line 39 which is attached to a belt 40 around the waist of a workman 20.

Figure 3:
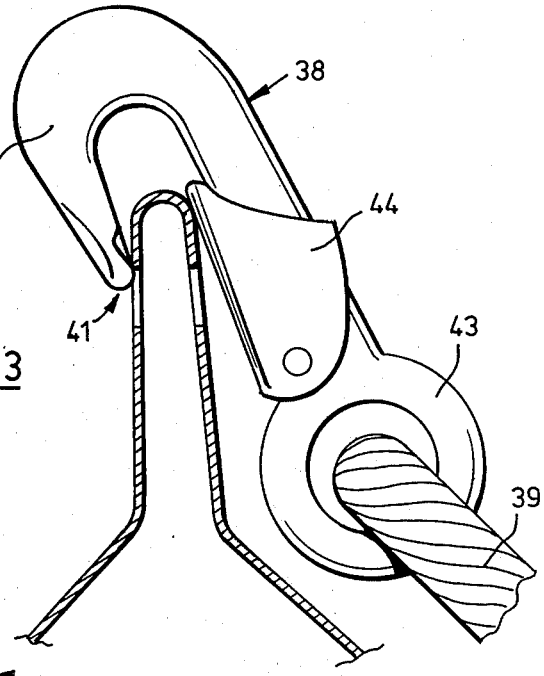
FIG. 3 is a vertical sectional view through the upper portion of the attachment member of FIG. 2, showing a clip in the initial phase of engagement with the attachment member.

Looking more specifically at the clip 38, it will be seen by comparing FIGS. 3 and 5 that the hook 37 has a leading point 41 with a flattened transverse section, the section closely adjacent the end of the point being shown in FIG. 5. As can be seen, the section has a maximum dimension A and a minimum dimension B. The maximum dimension A is measured in a direction transverse to the general plane of the hook portion 37, which is the plane of the paper as seen in FIG. 3, and which is shown in FIG. 5 by the broken line C.

Figure 4:
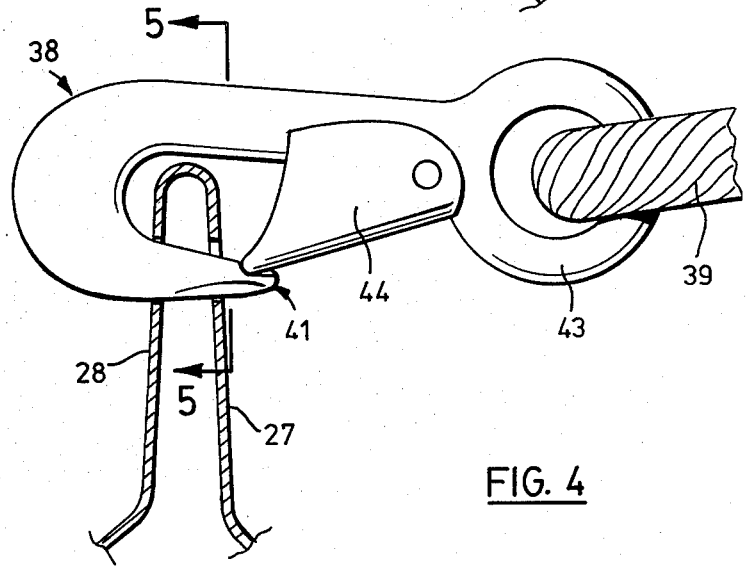
FIG. 4 is a view similar to FIG. 3, showing complete engagement of the clip with the attachment member.

As seen in FIGS. 2 and 5, the aperture 36 is elongated in the direction parallel with the 180° bend at the top 30, and specifically has a length D greater than the said maximum dimension A, and further has a width E which lies between the maximum A and minimum B dimensions. By arranging the geometry in this manner, the clip 38, once inserted in the aperture, 36, cannot be rotated beyond a limited arc. In the particular embodiment illustrated in the drawings, the minimum dimension B adjacent the leading point 41 of the hook 37 expands to some extent in the direction away from the leading point 41, so that the fit between the hook and the aperture 36 is somewhat more snug at the panel 28 that it is at the panel 27, as can be seen in FIG. 4. Nonetheless, the basic geometric prerequisite required to limit the arcuate rotation of the clip once inserted exists at both panels 27 and 28.

As seen in FIGS. 3 and 4, the clip 38 has the usual ring structure 43 remote from the hook portion 37, through which the safety line 39 may be attached. The clip 38 also has a pivoted lock member 44 which is spring loaded toward the open position (that shown in FIG. 4).

It has been found that, if the aperture 36 is made large enough (for example in a circular configuration) to allow full rotation of the clip 38 when engaged as shown in FIG. 4, and if the width of the strip of metal constituting the attachment member is narrow enough to allow the clip to rotate through 90° so that its general plane (shown by the letter C in FIG. 5) lies horizontally or practically so, it is possible with certain kinds of clip constructions to dislodge the clip from engagement with the aperture merely by pulling in a particular direction on the line 39. This direction would be that required to "rotate" the clip 38 out of the aperture 36, such that the leading point 41 is withdrawn backwardly from the aperture.

The construction shown in the figures and described above eliminates this risk, because it prevents rotation of the clip 38 through 90°, even where the width of the strip of metal constituting the attachment member is narrow enough to allow such rotation.

Turning briefly again to FIG. 1, the safety line 39 may be either tied by the belt of the workman, or run through a conventional "snagging" device which is adapted to allow the safety line 39 to move through it, but which will snag or grab the safety line if the worker should slip or fall from his perch.

The metal of the attachment member is sufficiently resilient to allow the leg portions 32 to be readily deformed to some degree in order to accommodate a range of roof peak angles.

At the end of the roofing operation, just before the final application of the inverted V-shaped roofing tile longitudinally of the peak of the roof, the workman simply takes a hammer and pounds the upstanding portion 26 down against one of the leg portions 32, so that it lies flatly thereagainst. This will eliminate the upstanding portion 26 as an obstruction, and will allow the V-shaped roofing tile to be applied without problem.

We claim:

1. For use with a clip connected to a safety line for roof workers, the clip including a hook portion having a leading point with a flattened transverse section, said section having a minimum dimension and having a maximum dimension transverse to the general plane of the hook portion:

an attachment member for roof peaks to which the safety line can be clipped, comprising a strip of metal bent to define an upstanding central portion consisting of two panels of the metal integral through a 180° bend at the top, each panel being integral at its bottom with an outwardly extending leg portion having means to allow attachment to structural roof members, the metal being such as to allow deformation without rupture, the central portion having an aperture for the insertion of the hook portion of said clip, the aperture being elongated in the direction parallel with the said 180° bend, and having a length greater than said maximum dimension and a width between said maximum and minimum dimensions, whereby the clip once inserted in the aperture cannot be rotated beyond a limited arc.

2. In combination:

a clip connected to a safety line for roof workers, the clip including a hook portion having a leading point with a flattened transverse section, said section having a minimum dimension and having a maximum dimension transverse to the general plane of the hook portion, and an attachment member for a roof peak, comprising a strip of metal bent to define an upstanding central portion consisting of two panels of the metal integral through a 180° bend at the top, each panel being integral at its bottom with an outwardly extending leg portion having means to allow attachment to structural roof members, the metal being such as to allow deformation without rupture, the central portion having an aperture for the insertion of said leading point of the hook portion, the aperture being elongated in the direction parallel with said 180° bend, and having (a) a length greater than said maximum dimension of said section, and (b) a width between said maximum and minimum dimensions, whereby the clip once inserted in the aperture cannot be rotated beyond a limited arc.

3. The invention claimed in claim 1 or claim 2, in which the means to allow attachment to structural roof members comprises openings in the leg portions for receiving nails.

* * * * *